US010246904B1

(12) United States Patent
White

(10) Patent No.: US 10,246,904 B1
(45) Date of Patent: Apr. 2, 2019

(54) GARAGE DOOR LOCKING APPARATUS

(71) Applicant: Bryan White, Encinitas, CA (US)

(72) Inventor: Bryan White, Encinitas, CA (US)

( * ) Notice: Subject to any disclaimer, the term of this patent is extended or adjusted under 35 U.S.C. 154(b) by 0 days.

(21) Appl. No.: 15/649,091

(22) Filed: Jul. 13, 2017

Related U.S. Application Data

(63) Continuation-in-part of application No. 15/044,893, filed on Feb. 16, 2016, now abandoned.

(51) Int. Cl.

| | |
|---|---|
| ***E05B 47/00*** | (2006.01) |
| ***E05B 65/00*** | (2006.01) |
| ***E05B 47/02*** | (2006.01) |
| ***E05B 17/22*** | (2006.01) |
| ***E05B 17/10*** | (2006.01) |
| ***E05D 15/22*** | (2006.01) |

(52) U.S. Cl.
CPC ..... *E05B 47/0001* (2013.01); *E05B 17/10* (2013.01); *E05B 17/22* (2013.01); *E05B 47/026* (2013.01); *E05B 65/0021* (2013.01); *E05D 15/22* (2013.01); *E05B 2047/0069* (2013.01); *E05D 2015/225* (2013.01); *E05Y 2900/106* (2013.01)

(58) Field of Classification Search
CPC .. E05B 41/00; E05B 47/0001; E05B 47/0046; E05B 17/10; E05B 2047/0097; E05B 2047/0072; E05B 2047/0067; E06B 3/44; E06B 3/70; E06B 2003/7046; E06B 2003/7044; E05D 15/16; G07C 9/00174
USPC ..... 160/188, 201
See application file for complete search history.

(56) References Cited

U.S. PATENT DOCUMENTS

| | | | | |
|---|---|---|---|---|
| 3,933,382 | A * | 1/1976 | Counts | E05B 47/0012 160/201 |
| 3,947,060 | A * | 3/1976 | Zimmer | E05B 47/0012 292/142 |
| 4,254,582 | A * | 3/1981 | McGee | E05B 47/0002 292/144 |
| 4,917,419 | A * | 4/1990 | Mora, Jr. | E05B 47/0002 292/144 |
| 5,533,561 | A * | 7/1996 | Forehand, IV | E05B 47/0002 160/188 |
| 5,611,382 | A * | 3/1997 | Sferra | E06B 9/52 160/113 |
| 6,382,005 | B1 * | 5/2002 | White | E05B 65/0021 160/188 |

(Continued)

*Primary Examiner* — Kathrine W Mitchell
*Assistant Examiner* — Johnnie A. Shablack
(74) *Attorney, Agent, or Firm* — Sandy Lipkin

(57) ABSTRACT

A garage door locking system that includes a single actuator locking box that integrates with existing garage door openers to form a system that is easy to install and that can not only open and close the garage door, but provide a sequential locking/unlocking function. The actuator utilizes a rack and pinion gear that moves the locking bar in a horizontal position to lock or unlock. A lighted indication LED extends from the system to the outside of the garage door so that the locked state of the door can be seen from the outside. The actuator box utilizes LED lights that light up to show proper alignment of the magnet mounted on the track Specialized clips both tie down the power cords from the actuator box and provide a magnetic activation that indicates to the CPU to move the bar to lock and also indicate the door position at all times.

5 Claims, 9 Drawing Sheets

(56) References Cited

U.S. PATENT DOCUMENTS

| | | | | |
|---|---|---|---|---|
| 6,580,355 | B1 * | 6/2003 | Milo | E05B 47/0012 340/5.7 |
| 7,010,947 | B2 * | 3/2006 | Milo | E05B 47/0012 292/144 |
| 7,032,418 | B2 * | 4/2006 | Martin | E05B 65/08 292/341.16 |
| 7,114,753 | B2 * | 10/2006 | Nodorft | E05B 47/0002 292/137 |
| 7,172,306 | B1 * | 2/2007 | Campa | E05B 17/10 362/100 |
| 7,240,524 | B1 * | 7/2007 | White | E05B 65/0021 292/144 |
| 8,113,263 | B2 * | 2/2012 | Reed | E05F 15/684 160/188 |
| 9,045,919 | B2 * | 6/2015 | Aragon | E05B 81/10 |
| 9,982,459 | B2 * | 5/2018 | Telljohann | E05B 41/00 |
| 2010/0088961 | A1 * | 4/2010 | Roten | E05D 7/1005 49/209 |
| 2016/0003922 | A1 * | 1/2016 | Smith | E05B 47/004 324/207.13 |

* cited by examiner

GARAGE DOOR LOCKING APPARATUS

BACKGROUND OF THE INVENTION

Reference to Prior Application

This application is a Continuation-in-part of application Ser. No. 15/044,893 filed Feb. 16, 2016 entitled GARAGE DOOR LOCKING APPARATUS by Bryan White, which claims priority of the provisional patent application 62/278,058, filed Jan. 13, 2016 entitled GARAGE DOOR LOCKING APPARATUS by Bryan White.

Field of the Invention

The present invention relates generally to the field of garage door locking systems, and more particularly toward a smaller, streamlined version of the prior art that includes a single actuator locking box that integrates with existing garage door openers to form a system that is easy to install and that can not only open and close the garage door, but provide a locking/unlocking function at the same time. The actuator utilizes a rack and pinion gear that moves the locking bar in a horizontal position to lock or unlock. There is a lighted indication LED that extends from the system to the outside of the garage door so that the locked state of the door can be seen from the outside of the garage door. The invention also includes specialized clips that both tie down the power cords from the actuator box and also provide a magnetic activation means therein that stimulate the motor to move the locking bar into the locked position. The actuator uses a remote control device to activate the door opening/closing as well as locking/unlocking. The device can also be opened and closed manually in the event of a power outage.

Description of the Prior Art

The instant invention is an improvement over prior art devices invented by the instant inventor that include issued U.S. Pat. Nos. 7,240,524 and 6,382,005. By contrast to the prior art inventions, the instant invention provides a streamlined, less complex and simpler improvement over the prior art. The instant invention includes only one actuator box, rather than two and the box is smaller than the prior inventions. The box utilizes a rack and pinion gear and magnets to communicate with the CPU 40 on the integrated circuit board 92.

Additionally, the instant inventions provides ease of installation use through the use of existing structures on most garage doors. The device integrates with existing garage door openers to provide a single system that both opens/closes the garage door and locks/unlocks at as desired. For garage door openers that use encrypted systems, an optional solenoid is available that bypasses the encrypted to keep the system streamlined. Specialized clips are included in the system that have the dual purpose of keeping the power cord tied down as well as providing a means therein to activate the actuator box. The system includes outside indicator lights to alert the user to the state of the lock. The optional solenoid mounts near any encrypted garage door opener that bypasses the encryption and simulates pushing the wall console rather than the user manually using his or her finger. The device is electronic but can be manually operated in the event of a power outage. The system is activated either through the wired wall button that is supplied with the instant invention which replaces the existing wall button mounted inside the garage that came with the garage door opener. It also comes with a remote control and an outdoor keypad supplied with the instant invention. Additionally, an optional solenoid component can be used for encrypted systems to press the wall button.

SUMMARY OF THE INVENTION

The preferred embodiment of the present invention teaches a garage door locking system and apparatus comprising: a garage door that is openable and closeable with a remote control system; a rolling track along which said garage door travels when opening or closing; an actuator box attached to said garage door said actuator box having an outer casing forming an interior portion; a power supply located outside of said actuator box; a CPU and circuit board for remote activation inside of said actuator box; a first reed switch; a second reed switch; a third reed switch, a locking bar; a rack gear attached to said locking bar; a pinion gear to cooperate with said rack gear; a magnet on said rack gear; a channel through said interior portion that extends out of said interior portion of said actuator box through which said locking bar can move into a locking position or an unlocking position; and a magnetic external actuator built into the clip that mounts to the track to activate said CPU to activate said motor to move said rack gear with said pinion gear that is activated when said magnetic external actuator comes into alignment with one of said reed switches wherein said first reed switch moves said locking bar into the locked position.

The above embodiment can be further modified by defining that said actuator box includes an external LED indicator light that illuminates when said magnetic external actuator comes into alignment with third reed switch.

The above embodiment can be further modified by defining that said locking bar terminates in a gripping handle for manual operation in the event of a power outage.

The above embodiment can be further modified by defining that a second LED indicator light extends from said actuator box to the outside of said garage door indicating that said system and apparatus is in the locked position.

The above embodiment can be further modified by defining that said magnetic external actuator includes a clipping element to clip said magnetic external actuator to said rolling track of said garage door.

The above embodiment can be further modified by defining that said magnetic external actuator includes a second clipping element for the securement of said power cord therein.

DETAILED DESCRIPTION OF A PREFERRED EMBODIMENT

Figure 1:
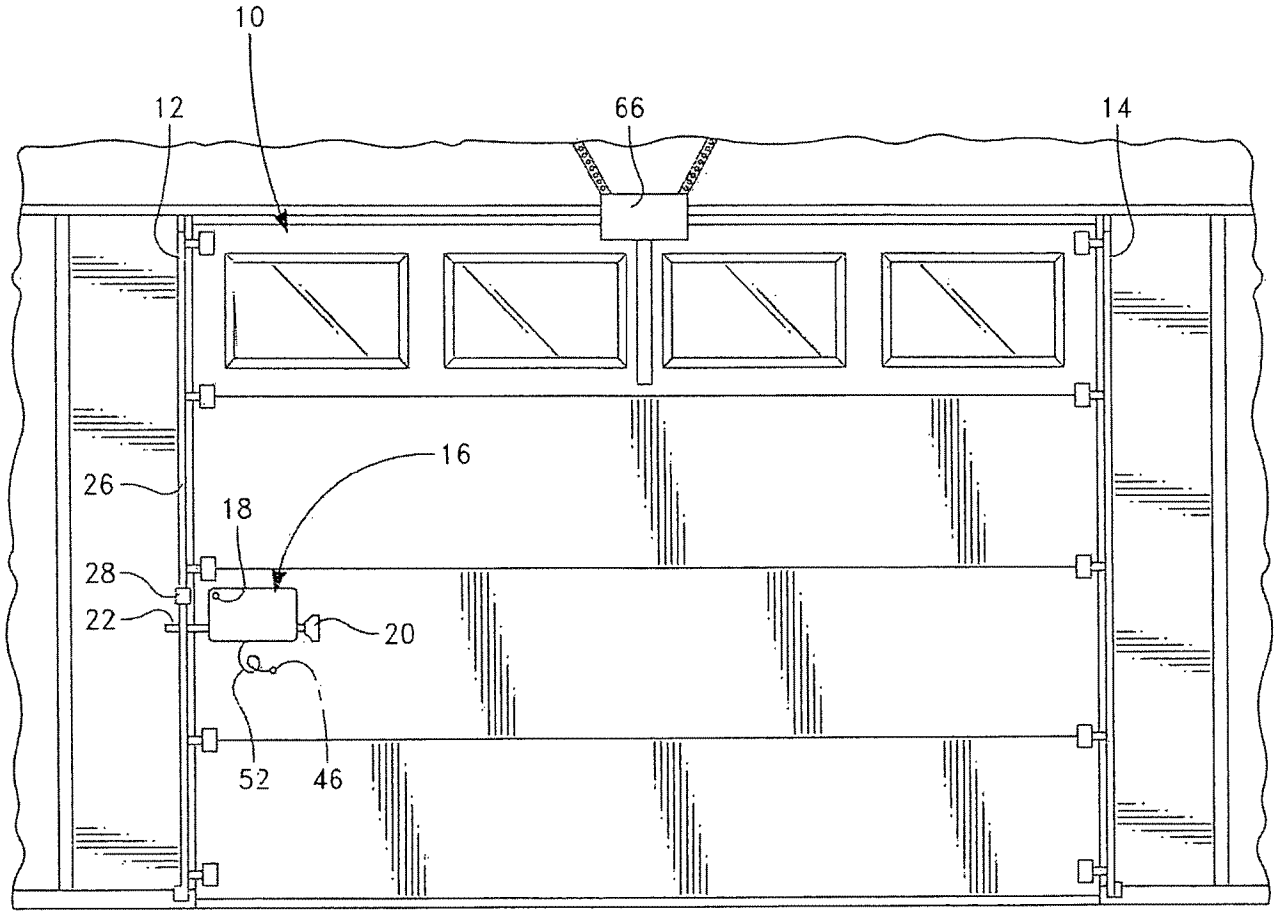
FIG. 1 is a front view of a garage door with the apparatus seen in phantom as it attaches to the inside of the garage.

Turning to the drawings, the preferred embodiment is illustrated and described by reference characters that denote similar elements throughout the several views of the instant invention.

The preferred embodiment of the instant invention is illustrated in detail in FIGS. 1-7B. The actuator box 16 is attached to the existing structures of an automatic garage door 10. A standard garage door 10 typically has a front face, a left side 12 while facing the door 10 from the inside and a right side 14. As illustrated, the actuator box 16 is attached to the left side 12 as seen in FIG. 1. Each side of the door 10 on the inside is supported by posts and rails along which the door 10 travels as it moves from the open to the shut position. It is on the left side of the garage door 10 that the actuator box 16 is to be mounted as seen in FIGS. 3A-3B. The actuator box 16 mounts to the garage door 10. It mounts to the moving door 10 or door end caps that move with the door 10.

Figure 3A:
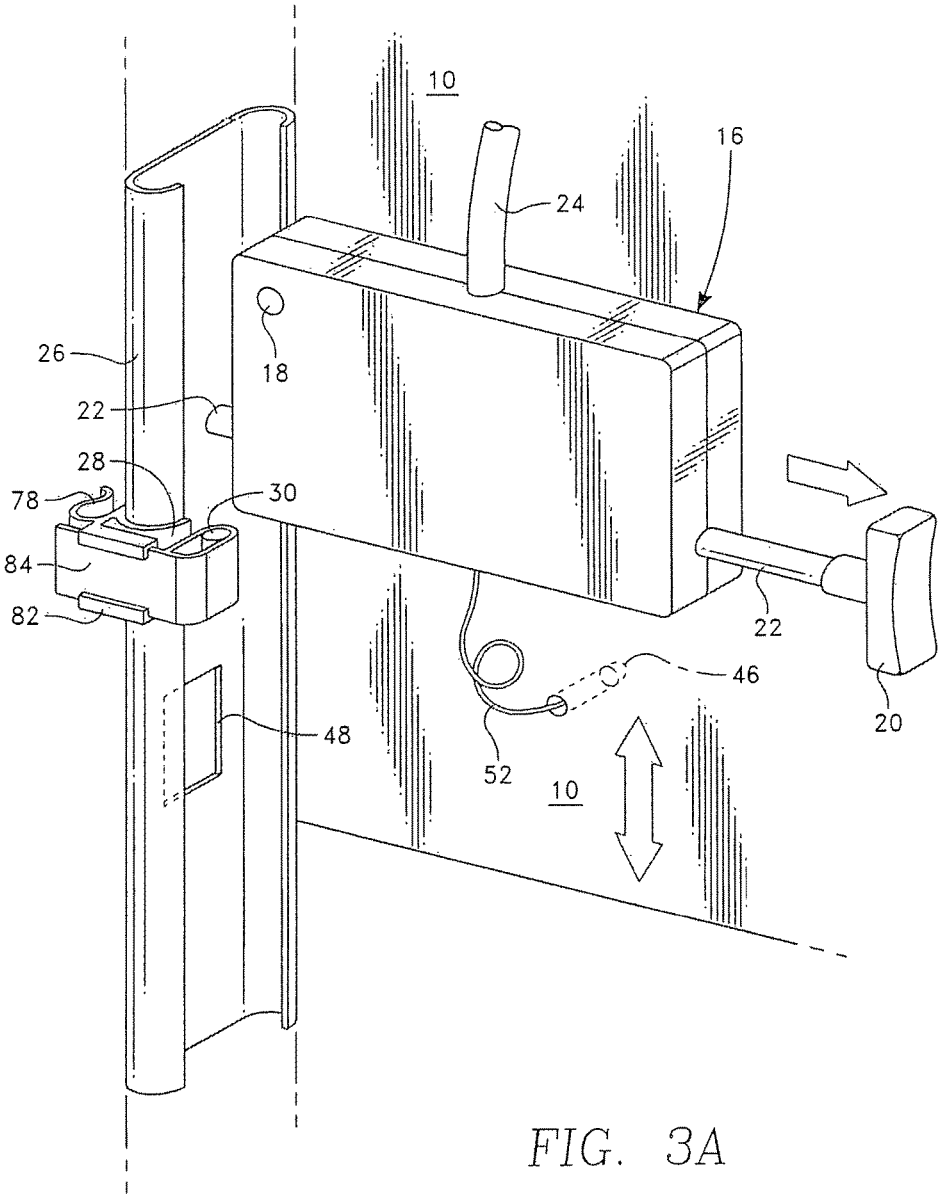
FIG. 3A is a close up perspective view of the actuator box of the instant invention as it attaches to the inside of the garage in the unlocked position.
Figure 3B:
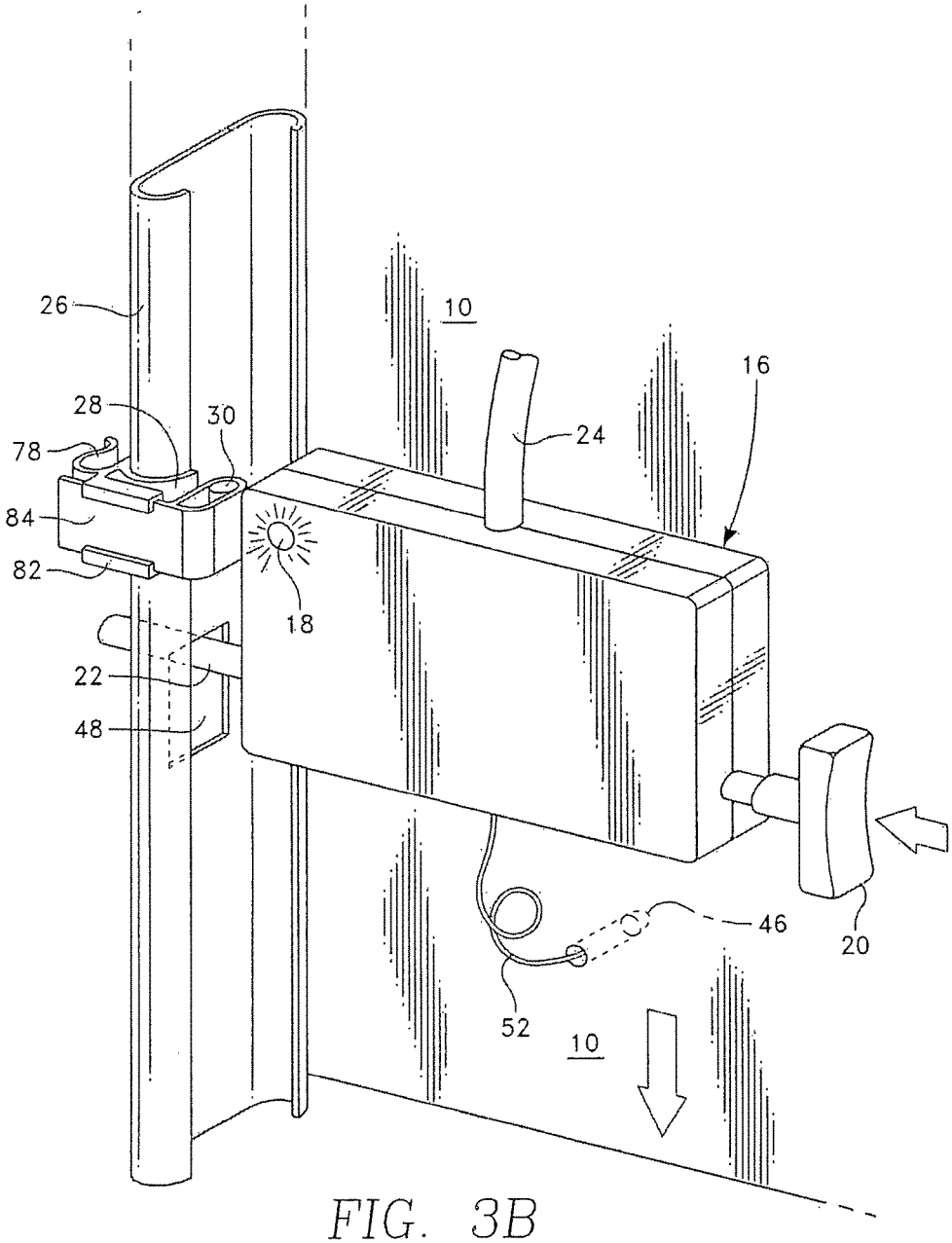
FIG. 3B is a close up perspective view of the actuator box of the instant invention as it attaches to the inside of the garage in the locked position.

The actuator box 16 can be mounted on the garage door 10 in any position as indicated by the vertical arrows in FIG. 3A. Apertures 48 can be already in place or can be drilled to allow for a place for the locking bar 22 to enter in order to lock the garage door 10 when it is in the closed position. An indicator light 46 is attached to the actuator box 16 and is visible from the outside of the garage door 10 so that the user will know whether or not the garage door 10 is locked. A hole must be drilled into the garage door 10 in order for the light 46 to pass therethrough. The light 46 which is attached to the actuator box 16 through a wire 52 then mounts through a bezel to provide a clean finish on the outside of the garage door 10.

The actuator box 16 also includes an indicator light 18 that illuminates when properly aligned with the magnet 30 clipped to the track 26. The locking bar 22 has an easy-to-grip handle 20 on one end that is permanently extended outside of the actuator box 16 for manual operation in the event of a power outage.

Figure 2:
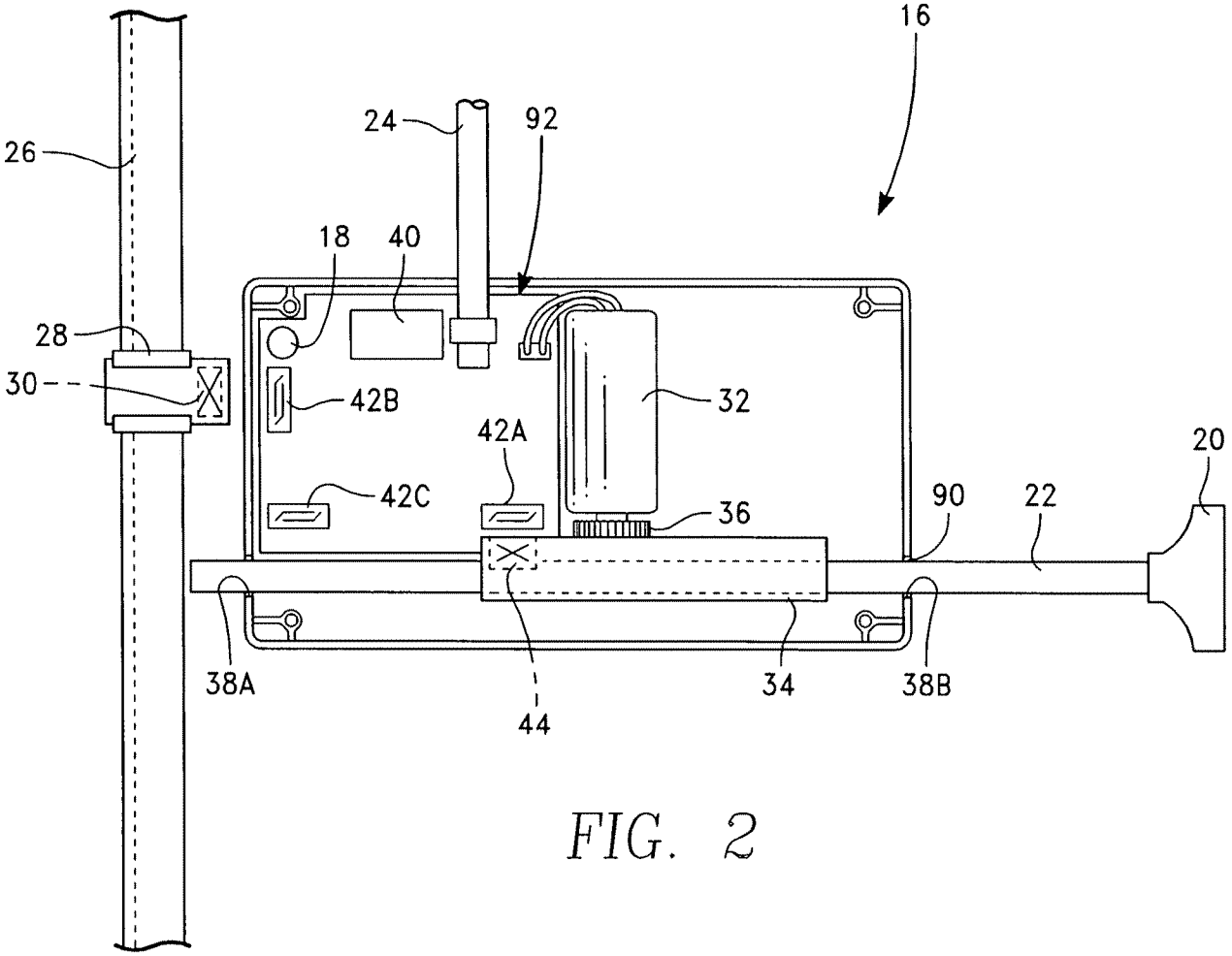
FIG. 2 is a close up internal front view of the actuator box of the instant invention.

FIG. 2 illustrates the internal operating system of the actuator box 16. Attached to the rolling track 26 are specialized clips 28 that include an external magnet 30 integrated therein that closes a switch with what is referred to herein as the third reed switch 42B. The specialized clips 28 serve the dual purpose of providing a secure slot 78 for the placement therein of the power cord 24, but more importantly the clip 28 houses the external magnet 30 therein that identifies the position of the garage door to the CPU 40 door open or closed when the system is activated through the depression of the wall button or remote control.

The system is activated either through depression of the wall button that comes with the garage door lock or with a remote control supplied with the device of the instant invention. The button is wired to the garage door lock, but the remote control operates wirelessly. A keypad can also activate the opening or closing and locking or unlocking of the garage door. For encrypted door openers, a specialized solenoid (described below) can be used to bypass the encryption to act as a manual depression of the wall button originally supplied with the garage door opener.

Activation of the system is accomplished through the depression of the wired wall button or remote control. Once activated, assuming the garage door is open and unlocked, the CPU 40 inside of the actuator box 16 will receive the signal from the activation and will create a closed contact on the garage door opener terminals where the wall button original wires were connected which will cause the garage door opener to move and close the door until the third reed switch 42B is in alignment with the external magnet 30 on the clip 28.

When the door reaches its final closed position and stops, the external magnet 30 in the clip 28, which is clipped to the track and is therefore static, stationary and non-moving will be in a position that will line up with the third reed switch 42B due to the movement of the actuator box 16, and by extension the garage door, into position. Once the CPU 40 receives the signal that the third reed switch 42B is closed, the CPU 40 will command the motor inside of the actuator box to turn on and extend the locking bolt out of the enclosed actuator box 16 and into the aperture.

In the closed and unlocked position, the magnet 44 on the rack gear 34 is in alignment with the first reed switch 42A to indicate to the CPU 40 that the system is in the unlocked position. Once the third reed switch 42B is closed, then the CPU 40 instructs the motor to move the locking bar 22 into the locked position at which point the magnet 44 on the rack gear 34 lines up with the second reed switch 42C at which point the CPU 40 instructs the motor to turn off.

Once the door is closed and locked, in order to unlock and open the door, once again the system is activated with activation of the remote control or wall button to send a signal to the receiver in the actuator box that the system is to be unlocked and the door opened at which point the CPU 40 commands the motor to retract the locking bar 22 until the magnet 44 on the rack gear 34 is in alignment with the first reed switch 42A. The alignment of the magnet 44 on the rack gear 34 with the first reed switch 42A performs two functions. First, it will turn the motor off and second, it will close the contact electronically through the circuit board 92 that operates the door opener and the door will open.

The mechanical device of the instant invention is designed to work in conjunction with the electronics in order to integrate the door opening and closing with the door locking and unlocking in one movement rather than two. The electronics on the lock control the garage door opener as well as the locking function.

After the garage door is unlocked and opened, once the system is activated again through depression of the remote control or wall button, once again the garage door will come down to close because the electronics on the actuator box will cause the closed circuit to trigger the garage door opener. By activating the system, the garage door opener is then triggered, thereby simulating the action of the garage door opening and closing as it did before the lock was present. In the instant invention, the lock is the agent actually performing the door opening/closing function, but now there's a locking function being performed in sequence.

When the door is closed and locked and the user wishes to open it, he presses the remote control or wall button_at which point the locking bar 22 disengages from the locked position. When the locking bar 22 disengages it moves along the channel between_the apertures 38A, 38B and when the magnet 44 on the rack gear 34 aligns with the first reed switch 42A, that communicates to the CPU 40 that the switch is closed indicating to the CPU 40 that the locking bar 22 is in the unlocked position the CPU 40 instructs the motor to turn off and for the garage door to open. When the door is in the open/unlocked position, the user can press the wall button or the remote control causing the door to come down to the closed position. When the external magnet 30 lines up with the third reed switch 42B, it communicates with the CPU 40 to start the motor 32 to push the locking bar 22 into the channel between the apertures 38A, 38B into the locking position. When the magnet 44 on the rack gear 32 aligns with the second reed switch 42C, the CPU 40 recognizes that the door is locked and it can turn the motor 32 off and illuminate the LED light 18 that shines on the outside of the garage door 10 indicating that the door is locked and providing an indication thereof from the outside of the garage.

The actuator box 16 includes an outer housing that hides and protects the internal components. Inside of the actuator box 16 there are apertures 38A, 38B that provide a channel through which the locking bar 22 moves from the open to closed position. At the far end of the locking bar 22 is a handle 20 that allows for easy movement of the locking bar 22 in the event of a power outage. Along the locking bar 22 is a rack gear 34 that works in concert with a pinion gear 36 that is attached to the motor 32. The motor is run on electricity and is attached to a power cord 24. This power cord 24 extends beyond the actuator box 16 into a power supply 62 and then is plugged into a power outlet (not shown) (See FIGS. 4A-4B). The clips 28 serve an additional purpose of tying down the power cord 24.

Figure 5:
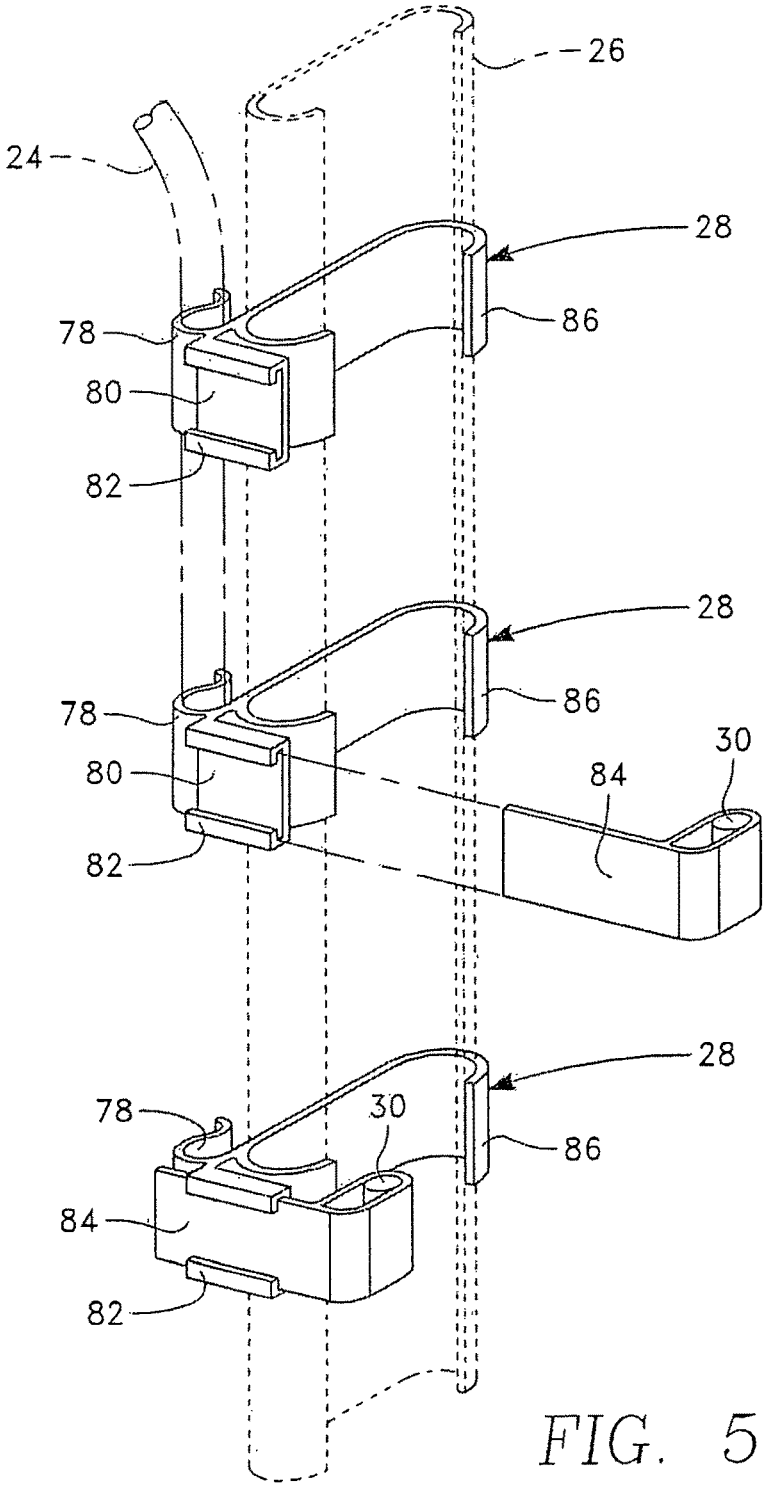
FIG. 5 is a close up view of the specialized clip of the instant invention.

FIG. 5 shows close up views of the specialized clip 28 both with the magnet 30 included and without. At the top of the figure, the top clip 28A does not include the magnet. There is a wrapping portion 86 that wraps around the roller track 26. Attached to this wrapping portion 82 is the channel 78 for the securing of the power cord 24. Between this channel 78 and the wrapping portion 86 is a channel 80 with a pair of flanges 82 for the optional placement of the slidable panel 84 of the magnetic piece 30. The magnetic piece 30 includes this slidable panel 84 that slides into the channel 80 and is secured through the flanges 82 for the inclusion of the magnetic portion 30 to any given clip 28. The second clip 28B down shows how the magnet 30 slides thereon with the bottom clip 28C showing the magnetic portion 30 fully secured to the clip 28.

As seen in FIG. 2 an electronic circuit board 92 runs the system and includes three reed switches with which it communicates to determine the position of the locking bar 22 as well as the position of the actuator box 16 relative to the clip 28 with external magnet 30. There is likewise a magnet 44 on the rack gear. These reed switches 42A, 42C indicate to the CPU 40 on the circuit board 92 the position of the locking bar 22. If the magnet 44 on the locking bar 22 is aligned with the first reed switch 42A, it indicates to the CPU 40 that the locking bar 22 is in the unlocked position and when reed switch 42B becomes aligned with external magnet 30 the CPU 40 will command the motor 32 to lock the garage door by moving the locking bar 22 through the channel between the apertures 38A, 38B into the locked position. If the magnet 44 on the rack gear 34 is aligned with the second reed switch 42C, it will indicate to the CPU 40 that the locking bar 22 is in the locked position and when activated the CPU 40 will command the motor 32 to unlock the garage door by moving the locking bar 22 through the channel between the apertures 38A, 38B into the unlocked position so that the garage door can be opened. An indicator light 18 on the outer housing of the actuator box 16 lights up when the magnet 30 in the clip 28 aligns with the third reed switch 42B.

The system is activated with a remote control (not shown) or with the wall button that comes with the garage door lock. As the garage door 10 moves vertically the actuator box 16 moves along with it. When the garage door 10 is in the closed position, the actuator box 16 will align with the magnet 30 in a clip 28. This alignment of the magnet 30 with the actuator box 16 when the garage door is in its fully closed position will be detected by the CPU 40 which will then communicate with the motor in the actuator box 16 to allow for movement of the locking bar 22 to the locked position.

The rack magnet 44 and the reed switches 42A 42C identify the position of the rack/locking bar 22 as one unit in the channel 90. The first and second reed switches 42A, 42C are mounted on the circuit board 92 that is located in the lock head of the actuator box 16. The magnet 44 in the rack 34 is used to close the switches 42A, 42C independently depending on the position of the rack 34. The reed switches 42A, 42C only close when the rack 34 is in one extreme end of travel or the other extreme end of travel. This will tell the CPU 40 which position the locking bar 22 is in, either fully locked or fully unlocked.

The third reed switch 42B is located on the same circuit board 92 but located at the end of the lock head closest to the right edge 12 of the garage door 10. This switch only closes when the magnet 30 that clips to the track 26 is sensed telling the CPU 40 which position the garage door 10 is in: either fully closed or not fully closed. To indicate proper magnet alignment with the door position magnet, there is a red LED light 18 located on the lock head that illuminates when things are in alignment. That allows for easy installation and adjustment.

An additional indicator LED light 46 is located on the end of the wire 52 and it mounts through the garage door 10 to illustrate when the locking bar 22 is in its fully locked position so the homeowner will know the lock is activated from the outside. The specialized 28 clips attach to the garage door track 26 securing the power cord 24 from touching any rollers or hardware on the moving garage door 10, then when the cord 24 reaches an outlet it is plugged in and the excess cord is neatly secured by a zip tie (not shown).

In most garage door systems there are apertures 48 along the rolling track 26 through which the locking bar 22 can be secured. In the event this is not the case, holes can be retroactively drilled therethrough.

Figure 4A:
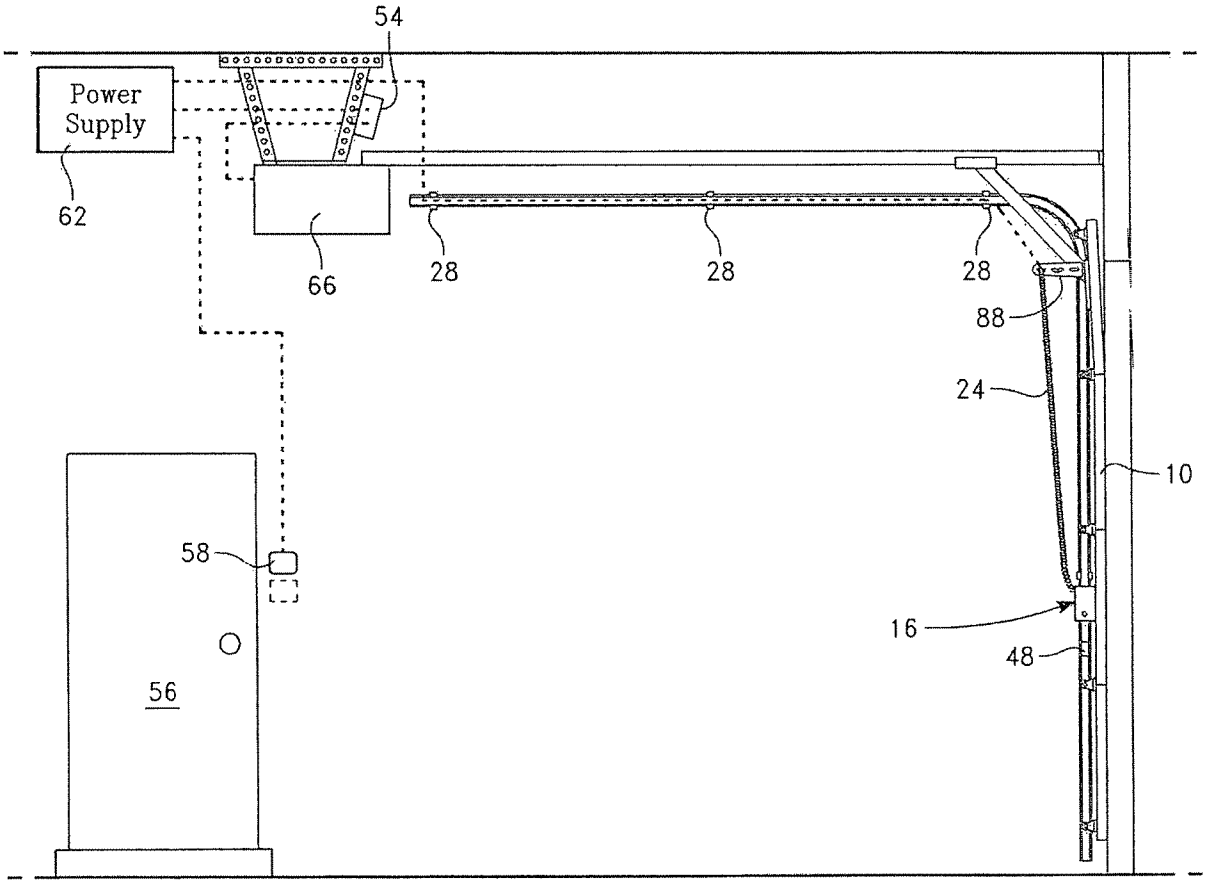
FIG. 4A shows a plan view of the system when used in conjunction with the optional solenoid for encrypted garage door opening systems.

The system includes an optional solenoid assembly 54 attachment for use with garage door openers that are encrypted. FIG. 4A shows a plan of a system that includes the solenoid assembly 54. The solenoid assembly 54 mounts near the garage door opener and serves the purpose of simulating the manual activation of the garage door opener without having to manually press the button with one's finger, effectively activating the encryption. As illustrated in FIG. 4A, the solenoid assembly 54 is mounted near the door opener 66 in the garage. In the case of encrypted systems, the wall button that came with the garage door is removed and replaced with a new button 58 that is supplied with the components of the instant invention. The wall button that was supplied with the garage door is installed with the solenoid assembly 54 to create a new integrated attachment so that the solenoid assembly 54 can depress the button supplied with the garage door when the new wall button 58 supplied with the instant invention is activated. The wall button/solenoid assembly connects to the garage door lock power supply 62 which is also connected to the wall button 58.

Figure 4B:
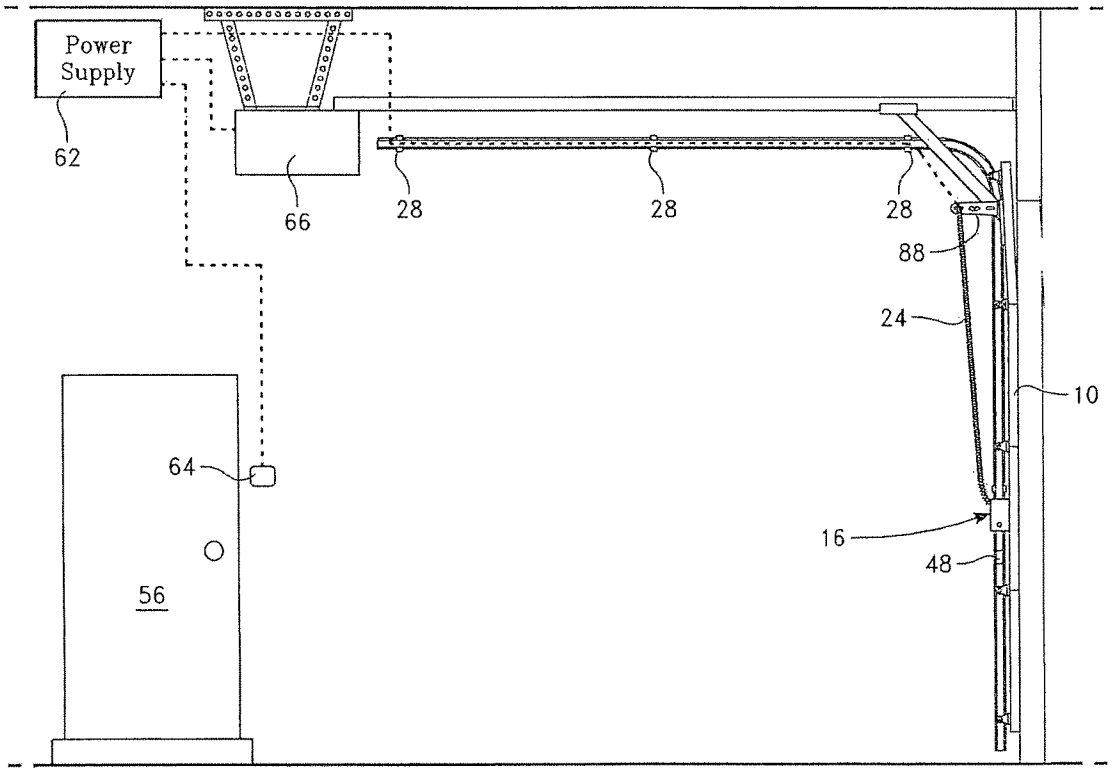
FIG. 4B shows a plan view of the system when used without the optional solenoid.
Figure 8:
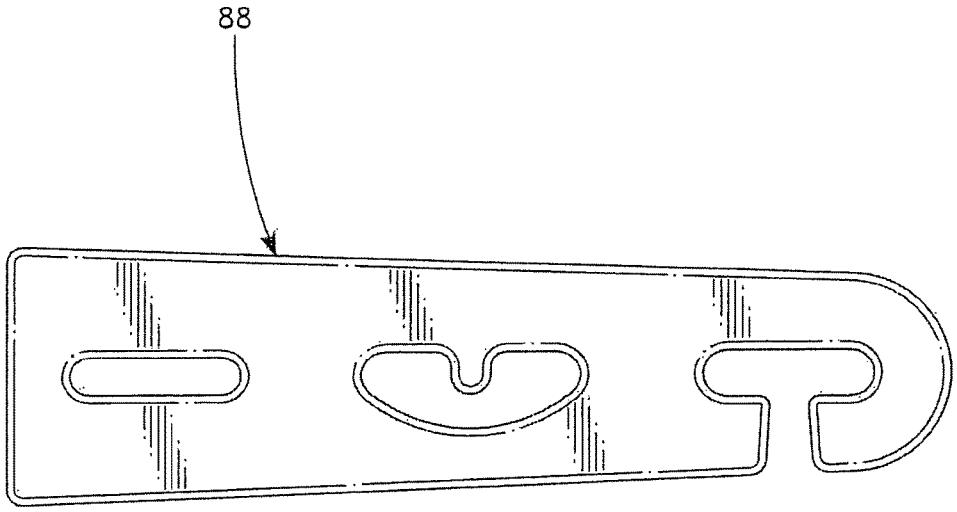
FIG. 8 is a close up view of the clip 88 used to organize power cords of the instant invention.

As seen in FIGS. 4A and 4B, clips 28 are located along the top horizontal section of the roller track 26. A special clip 88 (see FIG. 8) provides apertures through which the end portion of the power cord 24 that extends from the actuator box 16 as element 24 in FIG. 2 and fits and extends down toward the actuator box 16 thereby allowing the cord to reach the power supply 62 yet remain out of the field of travel of the garage door 10 as it opens and closes.

The wall button 58 is included in every lock kit. The solenoid assembly 54 is optional. FIG. 7B illustrates how the purpose is to completely open it so that the wall console can be mounted easily.

For systems without encrypted garage door openers (See FIG. 4B), no solenoid assembly is needed and the wall button 64 still gets replaced in all applications, but the solenoid assembly 54 is not needed. The solenoid assembly 54 connects to the power supply 62 which in turn presses the button for the garage door opener 66 that was previously mounted on the wall.

Figure 6:
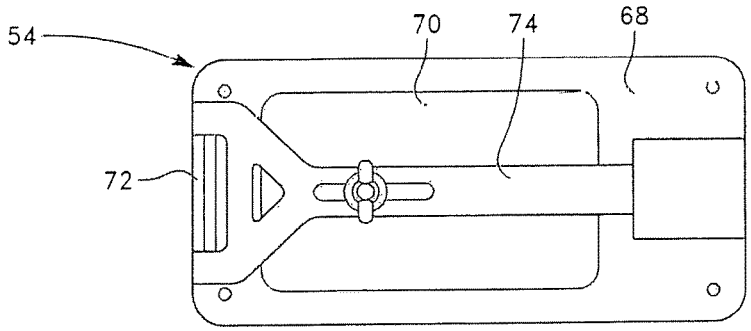
FIG. 6 is a top view of the optional solenoid of the instant invention.
Figure 7A:
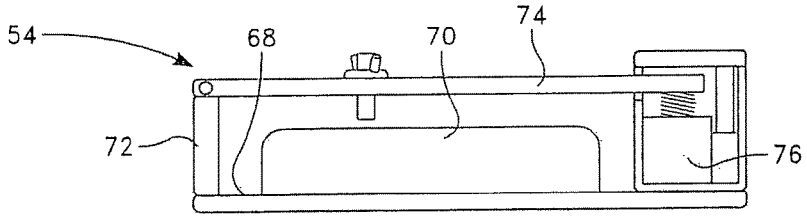
FIG. 7A is a side view of the optional solenoid of the instant invention in the unactivated position.
Figure 7B:
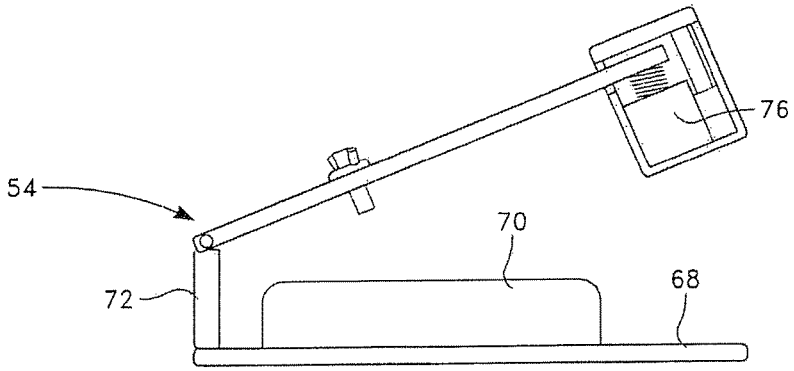
FIG. 7B is a side view of the optional solenoid of the instant invention in the open position for ease of mounting the wall console button.

The solenoid attachment is illustrated in FIGS. 6-7B. The solenoid 76 has a base 68 upon which rests a spot for a wall console or small switch 70. A backing piece 72 connects the base 68 to a top arm 74. The top arm 74 moves from a closed position (FIG. 7A) to an open position (FIG. 7B) to make installation of the console easy. When the solenoid 76 is activated, the top arm 74 pulls down and depresses the button.

The discussion included in this patent is intended to serve as a basic description. The reader should be aware that the specific discussion may not explicitly describe all embodiments possible and alternatives that are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A garage door locking system and apparatus comprising:

a garage door that is openable and closeable with an included remote control system or wall button that is independent of the remote control that was provided to open and close the garage door;

a rolling track along which said garage door travels when opening or closing;

an actuator box (16) attached to said garage door said actuator box having an outer casing forming an interior portion;

a power cord;

a power supply located outside of said actuator box attached to said power cord;

a CPU and circuit board inside of said actuator box which receives signals from said remote control system or wall button for activation to open and close said garage door;

a locking bar (22) with a rack gear (34) attached thereto and a magnet (44) attached to said rack gear;

a first reed switch (42A);

a second reed switch (42C) wherein said first and second reed switches are substantially parallel with and proximate said locking bar and when said magnet is proximate said first reed switch, said locking bar is in an unlocked position and when said magnet is proximate said second reed switch, said locking bar is in a locked position;

a third reed switch (42B);

a motor (32);

a pinion gear (36) to cooperate with said rack gear attached to said motor;

a channel through said interior portion of said actuator box that terminates in first (38A) and second apertures (38B) on said actuator box through which said locking bar can move into said locked position or said unlocked position wherein said locking bar can extend beyond said interior portion to lock said garage door or retract back therethrough to unlock said garage door; and an external magnet (30) incorporated into a clipping element that mounts to said rolling track of said garage door;

wherein said remote control system or wall button sends signals to said CPU to move said garage door to an open or closed position wherein when in said closed position said external magnet aligns with said third reed switch and said CPU identifies the position of said locking bar in said unlocked position said magnet on said rack gear is aligned with said first reed switch and said CPU commands said motor to move said locking bar to said locked position and turn off said motor and wherein when in said locked position said magnet on said rack gear is aligned with second reed switch wherein when said remote control system or wall button sends signals to said garage door to then open to the open position said CPU activates said motor to move said locking bar to the unlocked position and said magnet on said rack gear is aligned with said first reed switch and said garage door moves to the open position.

2. The garage door locking system and apparatus as defined in claim 1 wherein said actuator box includes an external LED indicator light (18) that illuminates when said external magnet comes into alignment with said third reed switch (42B).

3. The garage door locking system and apparatus as defined in claim 1 wherein said locking bar terminates in a gripping handle for manual operation in the event of a power outage.

4. The garage door locking system and apparatus as defined in claim 1 wherein an external LED indicator light extends from said actuator box to the outside of said garage door through an aperture indicating that said system and apparatus is in the locked position.

5. The garage door locking system and apparatus as defined in claim 1 further comprising a solenoid assembly said solenoid assembly further comprising a base, a backing piece connected to a base with a top arm attached thereto that moves from a closed position to an open position whereby when said solenoid is activated, said top arm pulls down and depresses said button.

* * * * *